US012385420B1

(12) United States Patent
Gill et al.

(10) Patent No.: US 12,385,420 B1
(45) Date of Patent: Aug. 12, 2025

(54) COMPOSITE ROCKER AND METHOD OF MAKING SAME

(71) Applicant: AWA FORGED COMPOSITES, LLC, Rolling Hills Estates, CA (US)

(72) Inventors: Bryan Gill, Palos Verdes Estates, CA (US); Joseph Abboud, Palos Verdes, CA (US); Cheyenne Valderrama, Pomona, CA (US)

(73) Assignee: AWA FORGED COMPOSITES, LLC, Rolling Hills Estate, CA (US)

( * ) Notice: Subject to any disclaimer, the term of this patent is extended or adjusted under 35 U.S.C. 154(b) by 0 days.

(21) Appl. No.: 18/972,202

(22) Filed: Dec. 6, 2024

Related U.S. Application Data

(60) Provisional application No. 63/606,919, filed on Dec. 6, 2023.

(51) Int. Cl.
*F01L 1/18* (2006.01)
*F01L 1/20* (2006.01)

(52) U.S. Cl.
CPC ..... *F01L 1/181* (2013.01); *F01L 1/20* (2013.01); *F01L 2301/00* (2020.05); *F01L 2305/02* (2020.05)

(58) Field of Classification Search
CPC ..... F01L 1/181; F01L 1/20; F01L 2301/00; F01L 2305/02
USPC ..... 123/90.36, 90.39, 90.45
See application file for complete search history.

(56) References Cited

U.S. PATENT DOCUMENTS

| | | | | |
|---|---|---|---|---|
| 4,438,738 | A * | 3/1984 | Kosuda | F01L 1/181 74/519 |
| 2017/0284233 | A1* | 10/2017 | Maehara | F01L 1/181 |
| 2018/0216501 | A1* | 8/2018 | Brown | F01L 1/181 |
| 2021/0156285 | A1* | 5/2021 | Hattiangadi | F01L 1/181 |

FOREIGN PATENT DOCUMENTS

| | | | | |
|---|---|---|---|---|
| GB | 2112897 | A * | 7/1983 | F01L 1/181 |

* cited by examiner

*Primary Examiner* — Jorge L Leon, Jr.
(74) *Attorney, Agent, or Firm* — Douglas B Teaney; CARDINAL LAW GROUP

(57) ABSTRACT

A rocker for a valve train for an internal combustion engine, wherein at least a portion of the rocker is fabricated from a carbon fiber-resin composite material, and a method for making same.

6 Claims, 5 Drawing Sheets

| **Criteria** | **Rocker Body** | **Wheel** | **Roller Pin** | **Fulcrum Bushing** | **Adjuster Insert** |
|---|---|---|---|---|---|
| Mass Reduction | *Optimization Grooves* | *Composite Insert* | *Composite Insert* | | *Material Selection* |
| Stiffness Enhancement | *Material Selection* | *Insert Material Selection* | *Insert Material Selection* | | |
| CTE Enhancement | *Material Selection* | | | | |
| Strength Enhancement | *Material and Manufacturing Selection* | *Insert Material Selection* | *Insert Material Selection* | | |
| Wear Resistance | | *Shell Material Selection* | *Shell Material Selection* | *Material Selection* | |
| Lubrication Enhancement | *Internal Oil Passages* | | | *X Groove* | *Oil Passage* |
| Valvetrain Geometry Enhancement | | *Enlarged wheel diameter* | | | |

FIG. 10

COMPOSITE ROCKER AND METHOD OF MAKING SAME

The present application claims priority under 35 U.S.C. § 119(e) of the filing date of U.S. Ser. No. 63/606,919, filed 6 Dec. 2023, the complete contents and disclosure of which are hereby expressly incorporated by reference.

TECHNICAL FIELD

The invention relates to designing and manufacturing components which are located in internal combustion engines. Specifically, this invention pertains to designing and producing rockers or rocker arms for valve trains for internal combustion engines.

BACKGROUND OF THE INVENTION

A rocker arm (or rocker, for short) is a valve train component in an internal combustion engine. In engines with a camshaft at the bottom of the engine, lifters push pushrods in an upward direction. The top ends of the pushrods, in turn, press upwardly, in a coordinated sequence, on ends of the rockers, causing the opposite ends of the rockers to move downwardly, which, in turn presses downwardly on the valves corresponding to the respective rockers, opening the valves. The rockers have pivot points incorporated into the body of the rocker, between one end that contacts the pushrod and the opposite end that contacts the top of the valve stem. A rocker operates by transferring the linear motion of the pushrod into rotational motion across a pivot, then transferring that rotational motion back into linear motion by pushing down on an upper retainer, which compresses a valve spring and pushes the valve down. When the pushrod retracts, the valve spring expands, pushing the valve stem upward, closing the valve, and causing the rocker to pivot in the reverse direction.

Roller rockers have a roller structure at one end (e.g., where the rocker contacts the top of the valve stem) or at both ends, to reduce friction, and correspondingly, wear.

Steel, titanium, and even aluminum, are used to fabricate present-day fulcrum-type rockers. However, such materials carry with them characteristics, such as high density, low strength-to-weight ratio, low stiffness, and high coefficient of thermal expansion ("CTE").

Moreover, in the environment of high-performance or racing engines, systems for extracting additional power from the engine, such as the injection of nitrous oxide, or super- or turbo-chargers, require that the engines operate with ever-increasing combustion chamber pressures, which, in turn, imposes increasing loads on fulcrum rockers, and their mountings. The increased engine pressures likewise implicate the use of valve stem springs having increased spring stiffness, which further increases the loads that the rockers must address.

In particular, the heavy and rapidly-moving masses found in a contemporary racing engine, in combination with the aforementioned increased valve spring forces, require rockers to transfer substantially increased loads, as compared to the levels of loading previously encountered by traditionally-fabricated rockers. In the past, the usual way to address such increased loadings was to add more material to the rockers to increase their stiffness. This, in turn, increases the mass, and thus the weight, of the rockers. Inasmuch as such traditional metals had relatively low stiffness for their mass, their operation could cause or facilitate the generation of potentially harmful harmonic vibrations, as well as reduced precision in valve operation. In addition, the relatively high CTE of such previously-used materials, leads to the deformation of the components when exposed to elevated temperatures and stresses. This, in turn, leads to changes in key dimensions of the components, further contributing to degradation in the accuracy of the valve timing, and in turn, engine efficiency.

Accordingly, it would be desirable to provide a rocker construction that enables the safe and efficient operation of a valve train, while simultaneously reducing weight, reducing or preventing component deformation, increasing component stiffness, and improving overall performance.

SUMMARY OF THE INVENTION

An aspect of the invention includes a rocker for a valve train for an internal combustion engine. In an embodiment, the rocker comprises a rocker body having a first end and a second end, a fulcrum aperture disposed between the first and second ends for mounting the rocker on an internal combustion engine, an adjuster aperture positioned at the first end, and at least one ear at the second end, for mounting a roller or wheel.

In an embodiment, the body is fabricated from carbon fiber composite material.

In an embodiment, the rocker further comprises an adjuster disposed in the adjuster aperture.

In an embodiment, the rocker further comprises a wheel/roller assembly mounted to the at least one ear.

In an embodiment, the roller assembly further comprises a wheel or roller pin and a wheel or roller, wherein the wheel/roller pin includes a wheel/roller pin shell and a wheel/roller pin insert, received within the wheel/roller pin shell, wherein the wheel/roller pin insert is fabricated from carbon fiber composite material and the roller pin shell is fabricated from metal, and wherein the wheel or roller includes a wheel/roller shell and a wheel/roller insert, received within the wheel/roller shell, wherein the wheel/roller shell is fabricated from metal and the wheel/roller insert is fabricated from carbon fiber material.

In an embodiment, the wheel/roller shell is fabricated from steel.

In an embodiment, the wheel/roller pin shell is fabricated from titanium.

In an embodiment, the rocker further comprises an annular insert inserted into the fulcrum aperture.

In an embodiment, the annular insert is fabricated from bronze.

In an embodiment, the rocker body further comprises one or more passages disposed within the body and fluidly connecting two or more of the adjuster aperture, the fulcrum aperture, and the roller pin aperture.

An aspect of the invention further comprises a method of designing a rocker for a valve train for an internal combustion engine, the method comprising the steps of:

- select a valve train configuration for an internal combustion engine;
- identify and select a known rocker configuration for the internal combustion engine, which corresponds to the identified valve train configuration;
- identifying performance issues for the known rocker configuration;
- identify design criteria for a replacement rocker to be fabricated, at least in part, from carbon fiber composite material;
- establish at least one design requirement, including at least one of determine required material properties to meet the identified design criteria, identify at least one suitable material to meet the determined material properties, select one or more manufacturing methods to meet the identified design criteria;

define a basic geometry for a rocker body having as a target meeting the at least one design requirement;

test the basic geometry using finite element analysis;

review results of finite element analysis and compare results against applicable safety requirements for a rocker body;

if the basic geometry fails to pass safety requirements, revise at least one of the identified at least one suitable material, the selected one or more manufacturing methods, and the defined basic geometry, until the applicable safety requirements are met;

establish at least one optimization criterion to be superimposed over the at least one design criterion to be an optimized design criterion for the basic geometry;

identify finite element analysis optimization techniques;

apply at least one experimental boundary, the at least one experimental boundary including at least one region of the rocker body to be exempted from optimization;

apply the at least one optimized design criterion;

perform optimization calculations;

compare optimization calculation results to the tested basic geometry;

if optimization calculation results do not meet the at least one design requirement, repeat the three preceding steps, and selecting at least one different optimized design criterion during each repetition until the optimization calculation results meet the at least one design requirement.

In an embodiment, the method further comprises the at least one design criterion further comprising at least one of:

a type of carbon fiber; a length of carbon fiber; a strength of a carbon fiber; a direction of placement of a carbon fiber; a pattern of placement of a carbon fiber; a type of resin to be used to bind carbon fiber; a desired density of carbon fiber in a final carbon-fiber-resin composite article; a strength characteristic of a final carbon-fiber-resin composite product.

In an embodiment, the method further comprises the strength characteristic comprising at least one of tensile, shear, compressive, creep and fatigue strengths.

BRIEF DESCRIPTION OF THE FIGURES

FIG. 10 is a chart illustrating design features for various aspects of the roller according to an embodiment of the present invention.

DETAILED DESCRIPTION

Figure 1:
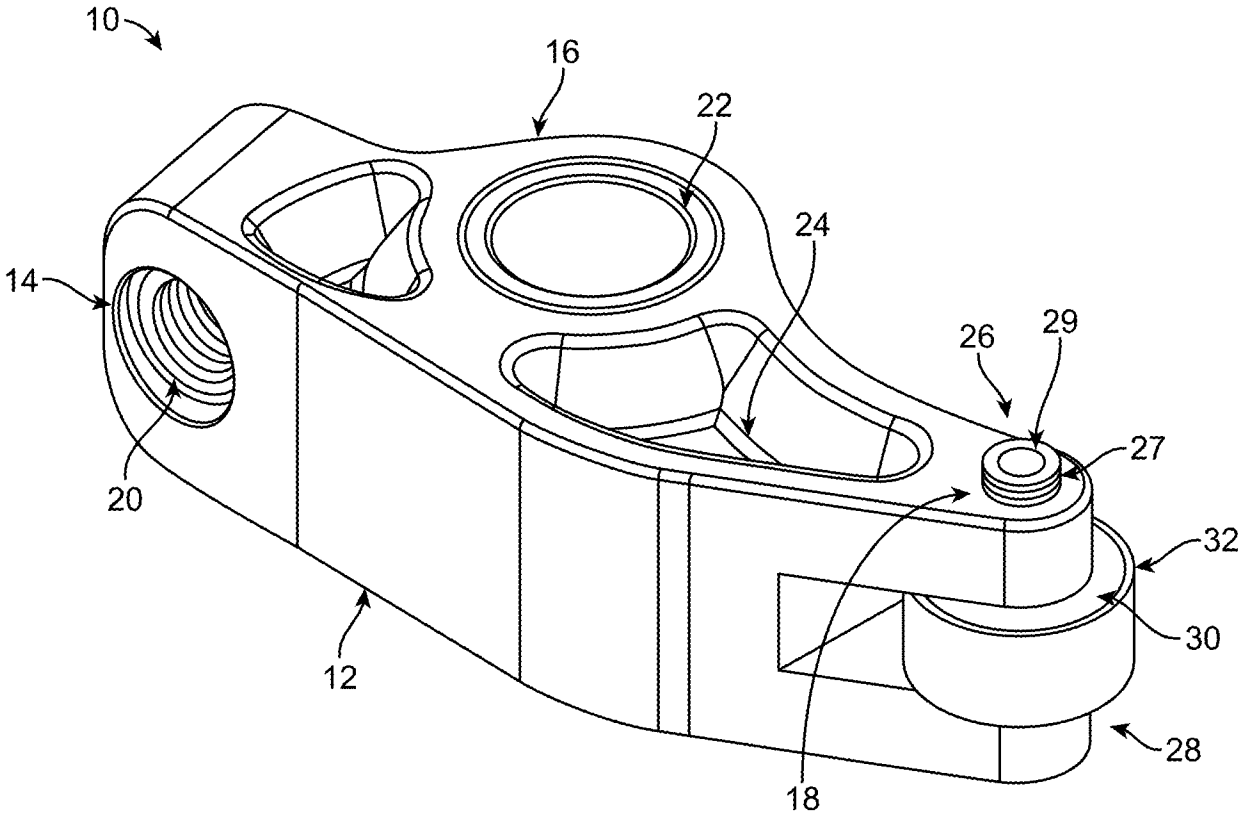
FIG. 1 is a perspective view of a rocker according to an embodiment of the invention.
Figure 4:
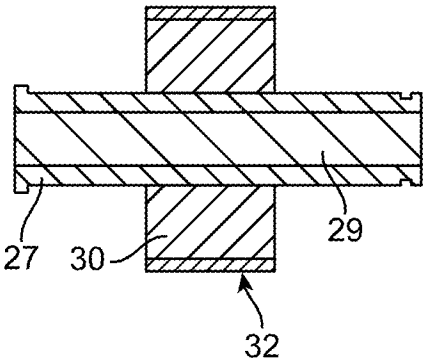
FIG. 4 is a side elevation, in section, taken along line 4-4 of FIG. 3.
Figure 3:
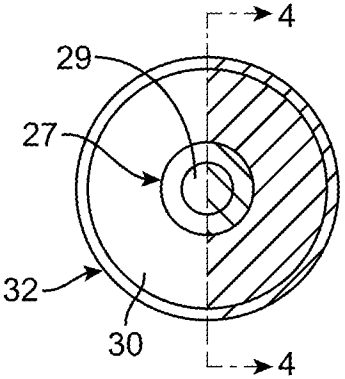
FIG. 3 is an end elevation, partially in section, of the assembly of FIG. 2.
Figure 2:
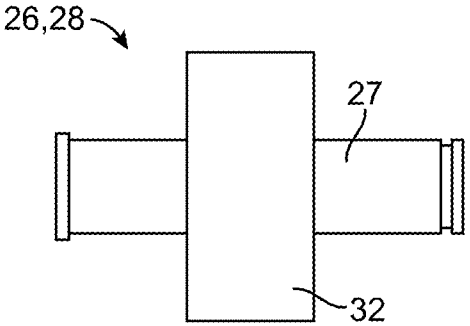
FIG. 2 is a side elevation of a roller and roller pin assembly, according to an embodiment of the invention.
Figure 6:
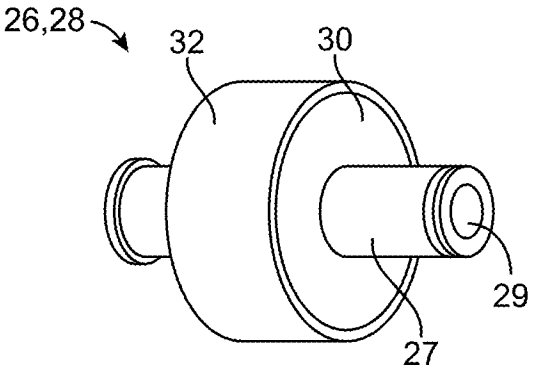
FIG. 6 is a perspective view of the assembly of FIG. 2.
Figure 5:
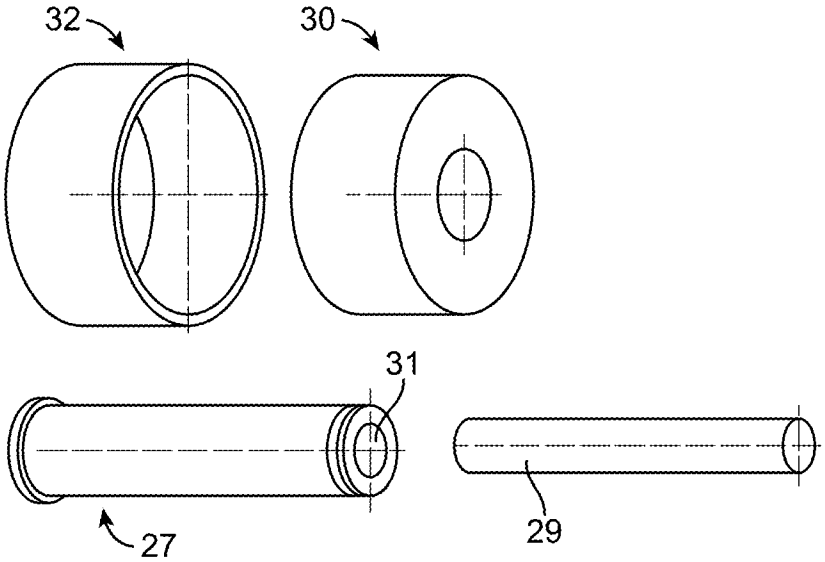
FIG. 5 is an exploded view of the assembly of FIG. 2.

While this invention is susceptible of embodiment in many different forms, there are shown in the drawings and described in detail herein, specific embodiments, with the understanding that the present disclosure is to be considered as an exemplification of the principles of the invention and is not intended to limit the invention to the embodiment(s) illustrated.

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventors can be their own lexicographers. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f) or pre-AIA 35 U.S.C. § 112~6. Thus, the use of the words "function," "means" or "step" in the Detailed Description of the Invention or claims is not intended to somehow indicate a desire to invoke the special provisions of 35 U.S.C. § 112(f) or pre-AIA 35 U.S.C. § 112~6 to define the invention. To the contrary, if the provisions of 35 U.S.C. § 112(f) or pre-AIA 35 U.S.C. § 112~6 are sought to be invoked to define the inventions, the claims will specifically and expressly state the exact phrases "means for" or "step for" and the specific function (e.g., "means for roasting"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f) or pre-AIA 35 U.S.C. § 112~6. Moreover, even if the provisions of 35 U.S.C. § 112(f) or pre-AIA 35 U.S.C. § 112~6 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and apparatus are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, apparatus and technologies to which the disclosed inventions may be applied. Thus, the full scope of the inventions is not limited to the examples that are described below.

Various aspects of the present invention may be described in terms of functional block components and various processing steps. Such functional blocks may be realized by any number of hardware or software components configured to perform the specified functions and achieve the various results.

The present application provides a new method for designing and producing fiber-reinforced polymer rockers which are lightweight, have increased strength, enhanced stiffness, and a low coefficient of thermal expansion, and general dimensional stability. These qualities are desirable for rockers in high performance applications.

While various specific methods of fabrication are described herein, other methods may be employed in alternative embodiments of the invention. Such alternative forming, machining and/or surface treatment methods may be similar or the same as those described in published international application WO 2023/154505 A, owned by the Applicant of the instant application, the entire contents of which are hereby expressly incorporated by reference.

FIG. 1 is a perspective view of a rocker according to an embodiment of the invention. Rocker 10 includes a carbon fiber composite body 12 having apertures 14 (at a first end of body 12), 16 and two apertures 18 (one for each of two ears located at a second end of body 12) for an adjuster insert 20, fulcrum bushing 22, and wheel (or "roller") pin 26, which supports wheel or roller 28 between the two ears of body 12. Body 12 further includes recesses, such as recess 24, which are provided at strategically-determined locations where mass, and thus weight, may be removed from body 12 without sacrificing strength, durability, or stiffness. Body 12 is fabricated from high-modulus or ultra-high-modulus composite discontinuous resin-infused carbon fiber materials. As an approximation, it is normally understood that the transition from "high-modulus" and "ultra-high-modulus" occurs at about 87 Mpsi (also referred to as "Msi").

The fibers are weighed, to ensure production consistency before being combined with a resin, such as, but not limited to, the resin sold under the commercial name of CYCOM(®) 52050-4 RTM, believed to be manufactured and/or sold by Solvay S.A., which is a homogeneous BMI resin for resin transfer molding (RTM) processes. In an embodiment of the invention, the fibers are randomly-oriented as a result of the mixing process and remain randomly oriented in the final product.

The carbon fiber-and-resin mixture is then placed in a heated mold to form into a first preliminary blank. The first preliminary blank is then placed in a compression mold (e.g., at an 8:1 ratio, that is from start to final size, the blank is reduced to 0.125 its initial volume) to form a secondary preliminary blank. In a preferred embodiment, the first preliminary blank is subjected to a pressure of 1 kilopascal +/−10%, for 20 minutes +/−10%.

Upon removal from the second mold, the secondary preliminary blank is cured in an oven at 480 degrees Fahrenheit for a period of time sufficient to fully cure the secondary blank. After the secondary preliminary blank has been cured, it is then machined into the final shape, as illustrated in FIG. 1.

FIGS. 2-6 illustrate the assembly of roller pin 26 and wheel 28.

In an embodiment of the invention, roller pin 26 comprises roller pin shell 27 and roller pin insert 29. In an embodiment of the invention, roller pin shell 27 is fabricated from Grade 5 titanium, and roller pin insert 29 is fabricated from resin-impregnated carbon fiber material, similar or the same as body 12. Roller pin shell 27 is, in an embodiment of the invention, formed from a blank in a two-stage process, again as described with respect to body 12, and then has a central bore 31 formed, e.g., by drilling or machining.

Wheel 28 comprises a carbon fiber composite wheel insert 30 molded or fitted into a wheel shell 32. In a preferred embodiment of the invention, wheel insert 30 is fabricated of the same carbon fiber composite as body 12. Wheel shell 32 is, in an embodiment of the invention, fabricated from 52100 alloy steel, although other steel alloys having similar performance characteristics may be employed.

In an embodiment of the invention, after final machining, body 12, wheel insert 30, and roller pin insert 29 are treated with a sodium silicate sealing solution. Wheel shell 32, roller pin shell 27, and adjuster insert 20 will, in an embodiment of the invention, have a DLC ("diamond-like carbon") coating.

It is believed that by providing both roller pin 26 and wheel 28 with two-part constructions, that of a carbon fiber composite "core" or "insert," surrounded by a metal sleeve or shell, the roller pin and wheel are provided with substantially stiffer constructions, particularly when considered in combination with the weight savings afforded by the use of the carbon fiber composite. Further, the use of the carbon fiber composite core or insert enables the omission of a bronze bushing in the roller or wheel, with the cost and weight savings afforded thereby. This is enabled by the low friction and high wear resistance of the roller pin 26 on the inner surface of the wheel 28 and supported by lubrication from oil passages 50.

Figure 7:
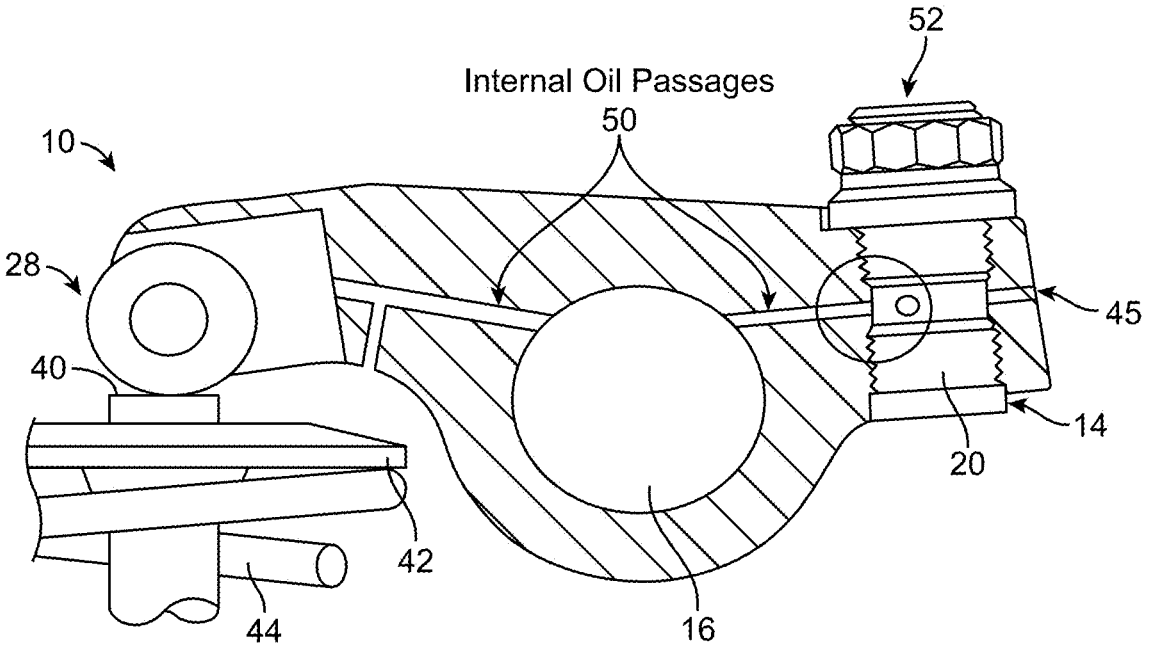
FIG. 7 is a side view, in section, of the rocker according to the embodiment of FIG. 1.

FIG. 7 is a side view, in section of the rocker 10 according to the embodiment of FIG. 1. Roller wheel 28 is illustrated contacting an upper surface 40 of valve stem and retainer 42 which is urged in an upward direction by valve spring 44. Adjuster insert 20 is illustrated receiving adjuster 52. Body 12 of rocker 10 further includes internal lubrication passages 50, formed by drilling, to provide lubrication for fulcrum bushing 22, adjuster insert 20, and roller pin 26. In an embodiment of the invention, passage 50 extending between aperture 16 and aperture 14 is formed by drilling, starting at the location in FIG. 7, designated by "45." Thereafter, the residual portion of passage 50 extending between aperture 14 and the nearest outer surface of body 12 is filled, e.g., with a temperature- and chemically-resistant epoxy material.

Adjuster 52, in an embodiment of the invention, again comprises a two-piece construction, specifically, an outer annular tube or sleeve, fabricated from metal, e.g., Grade 5 titanium, and having a threaded internal surface. A metal insert, having a correspondingly-threaded external surface, is threaded into the outer tube or sleeve. The metal insert is provided with additional threads to receive a nut, e.g., as illustrated. The metal insert likewise has an internal passage that communicates with lateral passages in the outer sleeve, which lateral passages, in turn, communicate with passages 50 in body 12. As is known in the art, the bottom end of the insert of adjuster 52 will have a surface which is either concave or convex, so as to "mate" with an upper end of a pushrod(not shown) of the engine. Such concave or convex surfaces will, in an embodiment of the invention, be coated with nickel aluminide to enhance surface hardness and improve wear characteristics.

Figure 8:
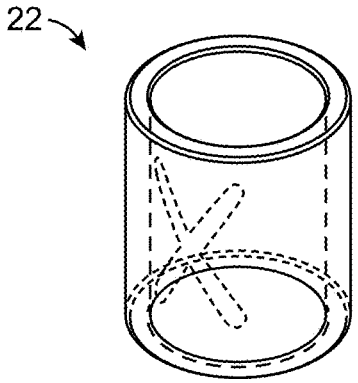
FIG. 8 is a perspective view of the fulcrum bushing of the rocker embodiment of FIG. 1.

FIG. 8 is a perspective view of the fulcrum bushing 22 of the rocker embodiment of FIG. 1. In a preferred embodiment, bushing 22 is fabricated from brass, such as C93200 bronze, although other metals, having similar wear and friction characteristics, may be employed, such as C95400 or C95500, C86300, C95800, C51000 or C54400. Bushing 22, in an embodiment of the invention, will be provided with an "X"-shaped through-passage to receive and evenly distribute lubrication oil.

In a preferred embodiment of the invention, one or more of each of the shells and inserts are coupled together with a close fit and fixed together, e.g., with any suitable epoxy material.

Figure 9:
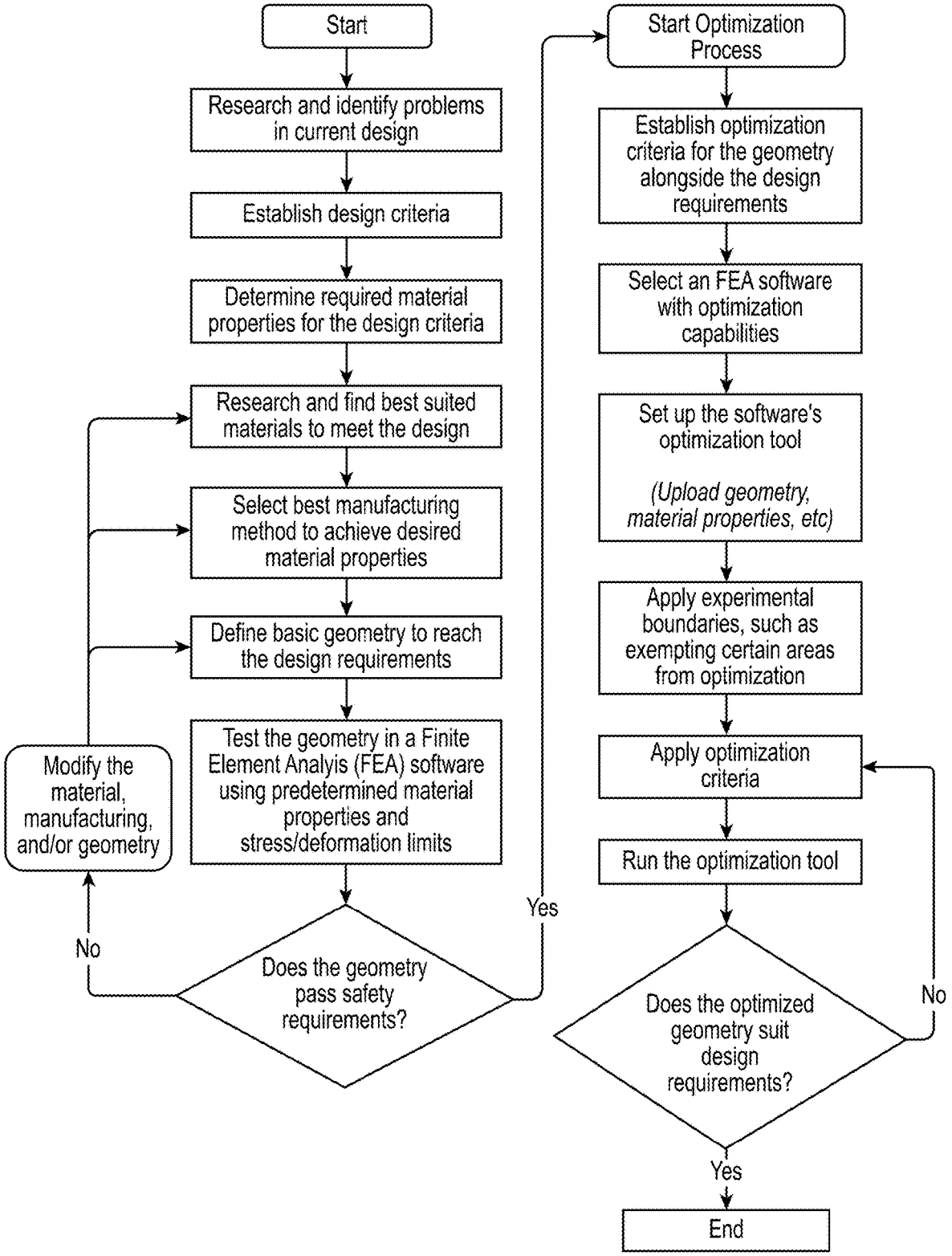
FIG. 9 is a flow chart illustrating an exemplary design process for producing the rocker according to an embodiment of the present invention.

FIG. 9 is a flow chart illustrating an exemplary design process for producing the rocker according to an embodiment of the present invention. The design process incorporates consideration of a number of design factors and criteria, which are, in turn, influenced by factors, such as, but not limited to, the type of engine being designed, its performance envelope, the performance expected and anticipated operating conditions. The design factors include, but are not limited to one or more of: the type of carbon fibers; the length of the fibers; the strength of the fibers; whether the fibers are to be laid in a unidirectional manner, a specific pattern or patterns, or entirely randomly; the type of resin used to bind the carbon fibers; the desired density of the finished composite product; the tensile, shear, compressive, creep and fatigue strengths required for the final product.

FIG. 10 illustrates a table addressing design features for various aspects of the roller according to an embodiment of the present invention. Table 10 identifies specific design criteria relevant to each component of the rocker.

In a preferred embodiment of the invention, optimization and analysis software marketed under the name Ansys 2023 R1, and its subtool Ansys Mechanical are employed, using, and processing the design criteria, selected materials and selected manufacturing methods.

While the embodiments of the invention disclosed herein are presently considered to be preferred, various changes and modifications can be made without departing from the spirit and scope of the invention. The scope of the invention is indicated in the appended claims, and all changes and modifications that come within the meaning and range of equivalents are intended to be embraced therein.

Although the invention has been described with reference to the above examples, it will be understood that many modifications and variations are contemplated within the true spirit and scope of the embodiments of the invention as disclosed herein. Many modifications and other embodiments of the invention set forth herein will come to mind to one skilled in the art to which the invention pertains having the benefit of the teachings presented in the foregoing descriptions and the associated drawings. Therefore, it is to be understood that the invention shall not be limited to the specific embodiments disclosed and that modifications and other embodiments are intended and contemplated to be included within the scope of the appended claims. Although specific terms are employed herein, they are used in a generic and descriptive sense only and not for purposes of limitation.

What is claimed is:

1. A rocker assembly of a valve train for an internal combustion engine, the rocker assembly comprising:

a rocker body fabricated from a carbon fiber composite material, the rocker defining:

a fulcrum aperture disposed between a first end and a second end of the rocker body such that the rocker body is configured to be pivotally mounted to the internal combustion engine via the fulcrum aperture, an adjuster aperture at the first end, and at least one ear at the second end an adjuster disposed in the adjuster aperture; and a roller assembly mounted to the at least one ear, the roller assembly including:

a roller pin configured to engage the at least one ear, the roller pin including a metal roller pin shell and a roller pin insert received within the roller pin shell, the roller pin insert fabricated from the carbon fiber composite material, and a wheel mounted to the roller pin, the wheel including a metal wheel shell and a wheel insert, received within the wheel shell, the wheel insert fabricated from the carbon fiber composite material.

2. The rocker assembly according to claim 1, wherein the roller pin shell is fabricated from titanium.

3. The rocker assembly according to claim 1, wherein the wheel shell is fabricated from steel.

4. The rocker assembly according to claim 1, further comprising an annular insert inserted into the fulcrum aperture.

5. The rocker assembly according to claim 4, wherein the annular insert is fabricated from bronze.

6. The rocker assembly according to claim 1, wherein the rocker body further defines at least one oil passage fluidly connecting at least two of the adjuster aperture, the fulcrum aperture, and the roller pin aperture to each other.

* * * * *